US005149174A

United States Patent [19]

Charash

[11] Patent Number: 5,149,174

[45] Date of Patent: Sep. 22, 1992

[54] ERGONOMIC STAND

[75] Inventor: Ruth A. Charash, 2012 Como Ave., SE., Minneapolis, Minn. 55414

[73] Assignee: Ruth A. Charash, St. Paul, Minn.

[21] Appl. No.: 723,581

[22] Filed: Jul. 1, 1991

Related U.S. Application Data

[63] Continuation of Ser. No. 411,103, Sep. 22, 1989, abandoned.

[51] Int. Cl.[5] ..... A47C 7/00

[52] U.S. Cl. ..... 297/423; 248/125

[58] Field of Search ..... 297/423, 429, 431, 438, 297/435, 187, 426, 424, 203, 4, 445; 248/125; 182/116

[56] References Cited

U.S. PATENT DOCUMENTS

| | | | |
|---|---|---|---|
| 3,029,106 | 4/1962 | McGuire . | |
| 3,181,828 | 5/1965 | Cramer | 248/125 |
| 3,477,673 | 11/1969 | Bereday . | |
| 3,704,847 | 12/1972 | Schmitt . | |
| 3,754,787 | 8/1973 | Garber . | |
| 4,328,991 | 5/1982 | Mengshoel et al. . | |
| 4,526,422 | 7/1985 | Mengshoel et al. . | |
| 4,589,699 | 5/1986 | Dungan | 297/423 |
| 4,650,249 | 3/1987 | Serber | 297/313 |
| 4,653,808 | 3/1987 | Opsvik . | |
| 4,767,160 | 8/1988 | Mengshoel | 297/423 |

FOREIGN PATENT DOCUMENTS

| | | | |
|---|---|---|---|
| 3515171 | 10/1958 | Fed. Rep. of Germany . | |
| 3607296 | 11/1987 | Fed. Rep. of Germany . | |
| 3304399 | 8/1988 | Fed. Rep. of Germany | 297/423 |
| 88/00016 | 1/1988 | PCT Int'l Appl. . | |
| 1347216 | 2/1974 | United Kingdom | 297/423 |

*Primary Examiner*—Karen J. Chotkowski

*Attorney, Agent, or Firm*—Merchant, Gould, Smith, Edell, Welter & Schmidt

[57] ABSTRACT

A support stand (10) is adapted to provide support to a standing person. The stand (10) has a planar base (12) upon which the person stands. A tilted and contoured seat cushion (22) supports the posterior of one person so that the pelvis is in an upright position and stress on the back is reduced. The knees are supported by a pad (24) which pivots to remain parallel to the shin bone. The seat cushion (22) is supported on a shaft (16) having telescoping members (26, 27) to adjust the height of the seat cushion (22). The shin pad (24) is supported on a telescoping member (28) extending from a shaft (20) and an angular adjustment (38).

9 Claims, 4 Drawing Sheets

FIG. 2
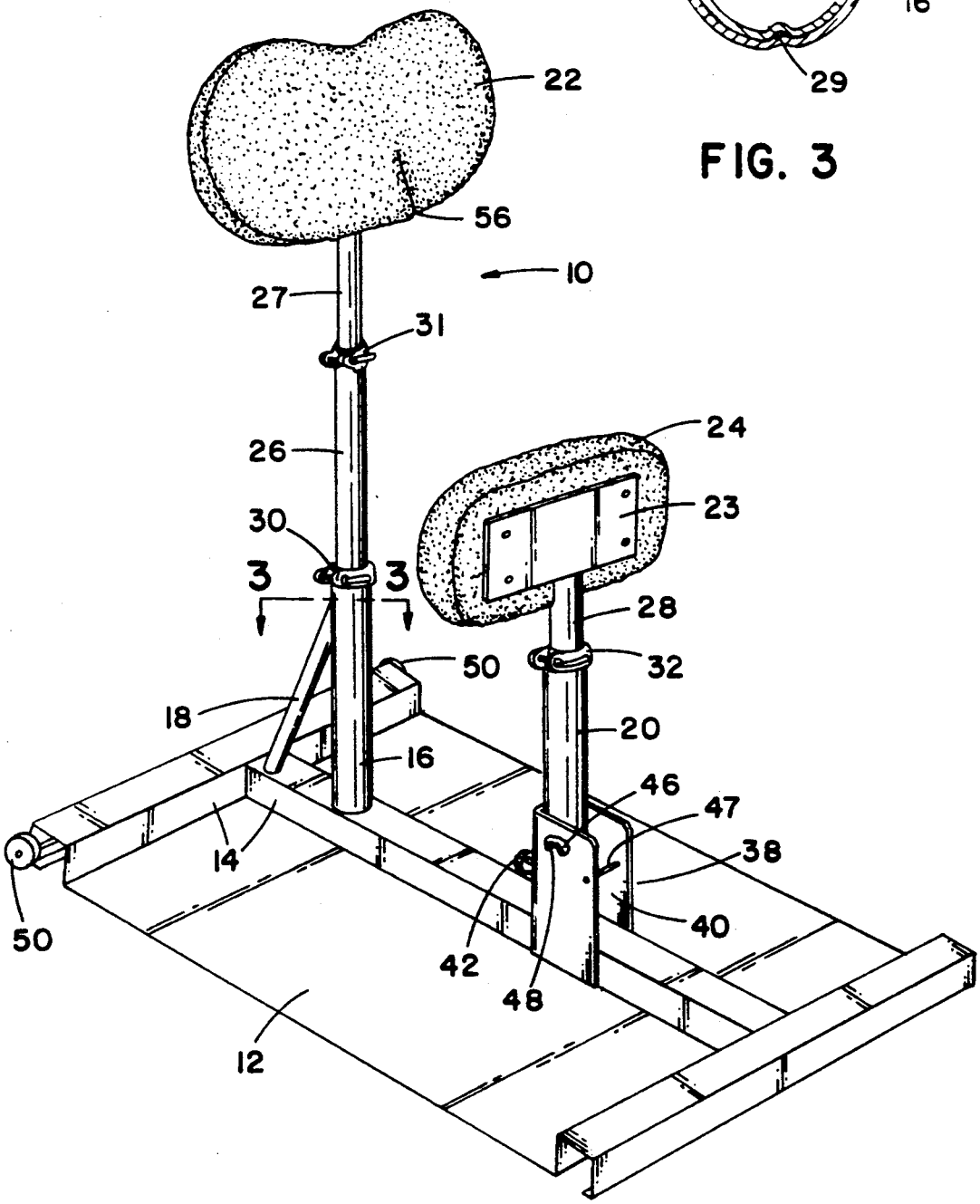
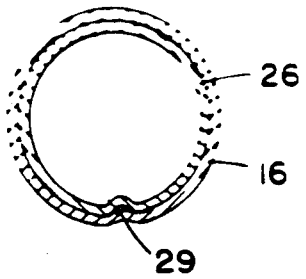
FIG. 3

ERGONOMIC STAND

This is a continuation of application Ser. No. 07/411,103, filed Sep. 22, 1989, now abandoned.

BACKGROUND OF THE INVENTION

The present invention relates to a device for supporting a standing worker in the least stressful position for the purpose of reducing back strain and fatigue, and minimizing swelling and discomfort in the lower legs.

Chairs and stands for reducing back strain and fatigue are well-known. Chairs that provide support at a user's posterior and knees are also well-known. Conveyor belts or assembly lines are not designed for seated employees, and conventional chairs will prevent employees from reaching their work without causing strain. Known chairs stands or leans do not support the body in the least stressful standing position, with the knees slightly bent and the pelvis maintained upright. Employees often use the stands like conventional chairs, which will prevent them from reaching their work.

Workers standing for prolonged periods of time and especially those performing forward reaches have heretofore not had adequate support to fully minimize back strain. To minimize back strain while standing, especially when reaching forward, it is important to have the knees slightly bent, the pelvis upright, and the back relatively straight. This position is considered the least stressful standing position by experts in preventing back injuries.

Back strain is common in conveyor or assembly line workers who perform reaching tasks. The strain is increased when the reach distance is greater, the object being lifted is heavier, or the reaching position is held for a longer period of time.

To determine the stress to the back from any type of reaching or lifting task, the bio-mechanical lifting equivalent, weight times distance, is used. The weights of the object and the parts of the body being lifted are multiplied by the distance between the area of greatest concentration of stress on the back and the farthest point of the reach. When reaching forward, a standing worker having no support for the pelvis and shins must lift more of their total body weight, thus increasing the strain to the back. Bending the torso forward and reaching with the arms fully extended can be equivalent to lifting as much as half of an individual's total body weight. It is therefore desireable to minimize forward bending of the torso, thereby decreasing the total body weight being lifted. By bending the knees and wedging the body upright between two vertical structures, the pelvis is maintained in an upright position, and forward bending of the torso is prevented. In order to keep the knees bent and the pelvis maintained in this position, it is essential to provide support to the shins and the buttocks. Standing with the knees slightly bent relaxes the muscles in the lower back, which also helps minimize back strain.

Another consideration is that prolonged standing, especially with little or no leg movement, can lead to swelling and discomfort in the lower legs and feet. To counteract this problem, it is important to minimize the amount of weight the legs must support. By wedging the body between two vertical structures that provide support to the shins and the buttocks, the total body weight supported by the legs is significantly reduced.

Thus it can be appreciated that a support stand is needed that supports the body in a least stressful position while standing. It can be further appreciated that a support stand is needed that easily and fully adjusts to the sizing requirements of each person, that is lightweight and easily transportable. The present invention solves these and other problems associated with support stands.

SUMMARY OF THE INVENTION

The present invention relates to an ergonomic support stand and in particular to a stand giving support to a person standing to reduce strains associated with standing.

According to the present invention, a support stand has a seat support cushion adapted for maintaining the pelvis and back of a person standing on the stand in the least stressful standing position to reduce strain. The seat support cushion is contoured and angled to maintain the pelvis of a person in an upright position to prevent bending and lifting of the torso to minimize the weight lifted and to reduce back strain. The stand has a shin support pad supporting the front of the shins for maintaining the knees in a slightly bent position to relax the muscles of the lower back and to help relieve swelling in the legs and feet. A flat base provides stability to the stand so that the stand cannot tip while a person is standing on the base or leaning against the seat and shin supports. The seat support cushion and shin support pad are adjustable for adapting to persons of different heights and weights. The angle of the shin support may be changed and the horizontal distance between the seat support and the shin support may be changed to adapt to different size users. When a person is supported in a properly adjusted stand, the body is wedged between the shin support pad and the seat cushion in one of the least stressful positions for standing.

These advantages and features of novelty and various others which characterize the invention are pointed out with particularity in the claims. However, for a better understanding of the invention, its advantages and the objects obtained by its use, reference should be made to the drawings and to the accompanying descriptive matter in which there is illustrated and described a preferred embodiment of the invention.

BRIEF DESCRIPTION OF THE DRAWINGS

In the drawings wherein like reference numerals and letters indicate corresponding elements throughout the several views;

FIG. 2 is a perspective view of the support stand shown in FIG. 1;

FIG. 3 is a sectional view of support members taken along line 3—3 in FIG. 2;

DETAILED DESCRIPTION OF THE PREFERRED EMBODIMENT(S)

Figure 1:
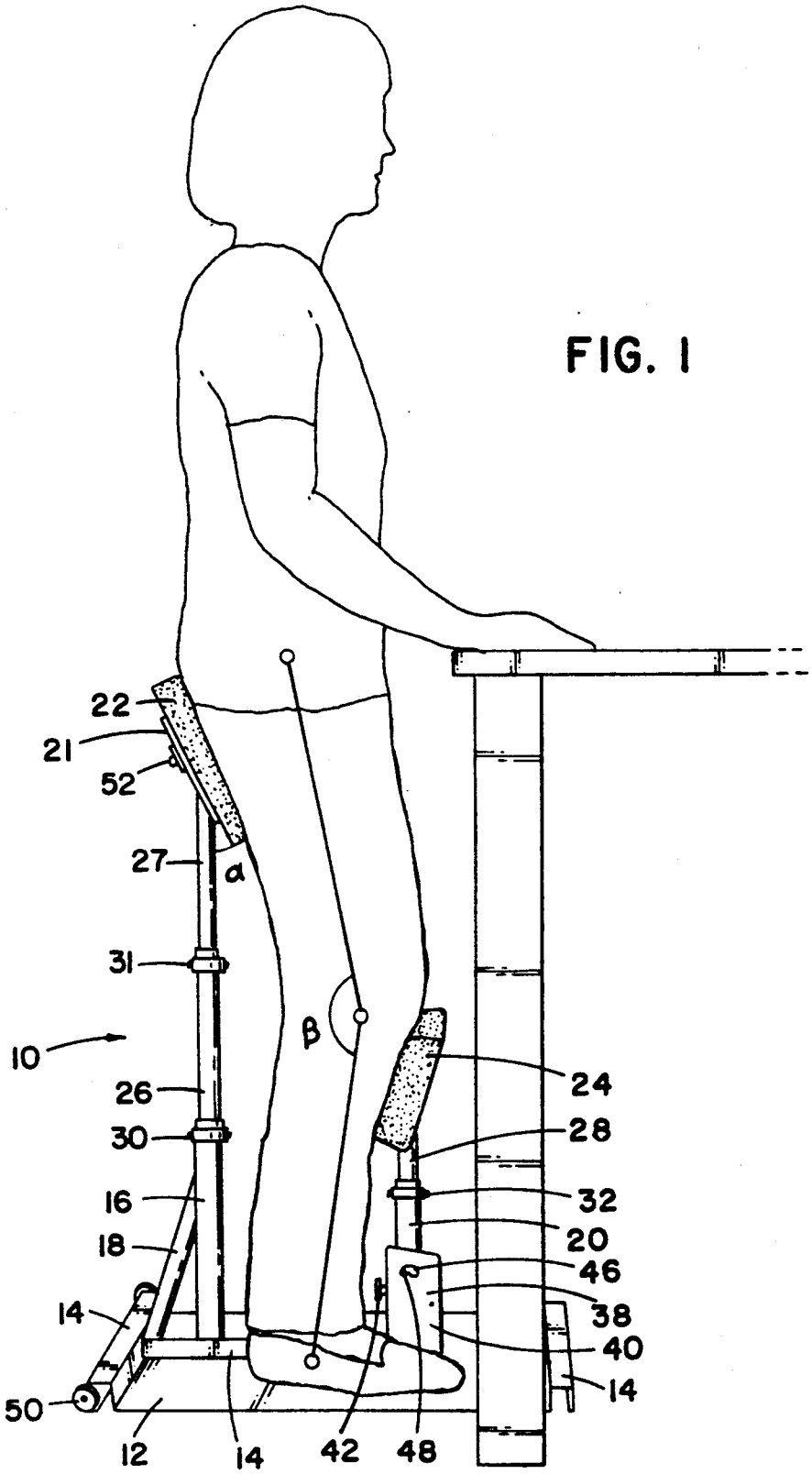
FIG. 1 is a side elevational view of a support stand according to the principles of the present invention.

A support stand 10 in accordance with the present invention to support the body while standing is generally shown in FIG. 1. The stand has a base 12 including a frame 14 supporting a seat shaft 16 and a bracket 40. Telescoping tubular members 26 and 27 extend from seat shaft 16 for supporting a seat cushion 22. A shin support shaft 20 with a telescoping tubular member 28 supporting a shin support pad 24 extends from bracket 40. The shin support shaft 20 is angularly and horizontally adjustable.

The base 12 has a flat planar portion proximate the ground so that a person will not fall walking onto or leaving the stand 10. The base 12 is covered with a fatigue reducing and vibration reducing mat (not shown) to reduce fatigue, to reduce swelling in the legs and to increase the comfort of a person using the stand 10. The frame 14 has cross members at front and rear edges of the base 12 and a center longitudinal member connecting the cross members to increase the rigidity and strength of the base 12. The frame 14 has a low ground-hugging configuration proximate the planar base 12 so that movement on the stand is restricted as little as possible and lateral movement is provided for a person supported on the stand 10. Base 12 has a width at least as great as the width of a person using stand 10 and a longitudinally length sufficient to allow the person to be wedged in place as will become apparent. The entire weight of the person is supplied to the base 12 and frame 14 so that the weight and indicated dimensions provide stabilization for stand 10.

The seat support shaft 16 extends vertically upwardly from near one end of the longitudinal member of frame 14. A support beam 18 also attaches to frame 14 and to the seat shaft 16 for added bracing. The telescoping members 26 and 27 extend up from the shaft 16. The contoured seat cushion 22 attaches to a back plate 21 at an upper end of the telescoping member 27. The seat cushion 22 is contoured to fit the posterior of a person leaning against the cushion 22. The cushion 22 has two slightly concave portions adapting to the posterior. A center ridge 56 along the lower portion of the cushion 22 maintains the sacrum in a slightly forward angled position which keeps the pelvis in an upright position and also prevents a person from sliding off the seat cushion 22. With two telescoping members 26 and 27, the seat cushion 22 can be lowered to a storage position so that the stand 10 requires less storage space. The height of the seat cushion 22 is controlled by height adjustment locks 30 and 31. The locks 30 and 31 control the length of the telescoping members 26 and 27 extending from the seat shaft 16.

Figure 4:
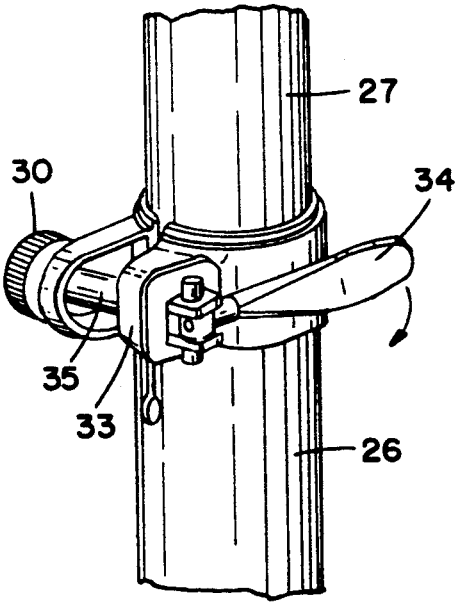
FIG. 4 is a perspective view of height adjustment means for the support stand of FIG. 1.

A typical adjustment lock is shown in FIG. 4. The lock 30 has a cammed lever 34 and a clamping member 33 held by a pin 35. The lever 34 is moved from the locked position shown to an unlocked position, moving a cam at the end of the lever 34. As lever 34 is moved, the cammed end rotates and disengages the clamping member 33 to loosen the clamping member 33 from telescoping member 26. Telescoping member 26 can then be infinitely adjusted within the range limited by the length of the telescoping member 26. Telescoping member 26 can then be moved so that the desired length of telescoping member 26 extends from seat support shaft 16, thereby changing the elevation of the seat cushion 22. To lock the telescoping member 26, the lever 34 is moved back to the locked position so that the cammed end engages the clamping member 33 to tighten the clamping member 33 on the telescoping member 26. Locks 31 and 32 shown in FIGS. 1 and 2 work in a similar manner to provide additional height adjustment.

As shown in FIG. 3, the telescoping members 26 and 27 have a mating tongue and groove 29 running along one side of the members 26 and 27 to prevent rotation of the members to maintain proper alignment of the seat cushion 22. Members 16 and 26 and members 20 and 28 are constructed with a similar tongue and groove arrangement.

As shown in FIG. 1, the seat cushion 22 and plate 21 is tilted at a fixed angle $\alpha$ between 25°–35° from vertical and preferably at about 30° from vertical to support the pelvis and upper body in a least stressful position for the body when standing. The pelvis is supported in an upright position so that a person using the stand 10 can reach forward without bending forward so that no additional strain is placed on the back.

As shown in FIGS. 1 and 2, a shin support pad 24 is located so that a person being supported by the seat cushion 22 is also supported at the front of the shin just below the kneecaps by the shin support pad 24 so that the body is wedged between the seat cushion 22 and the shin support pad 24. The shin support pad 24 mounted on a shin pad back plate 23 is supported with tubular telescoping member 28 mounted in the shin support shaft 20. The shin support shaft 20 is attached to a shin support adjustment assembly 38 mounted on the frame 14.

Figure 6:
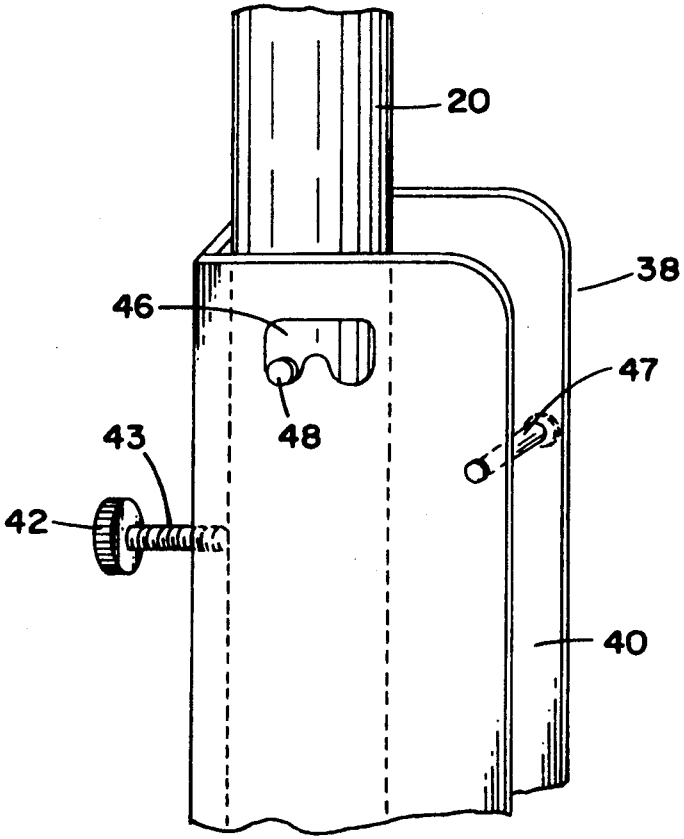
FIG. 6 is a perspective view of the shin support angle adjustment shown of FIG. 5 with the adjustment pin in a second position.
Figure 5:
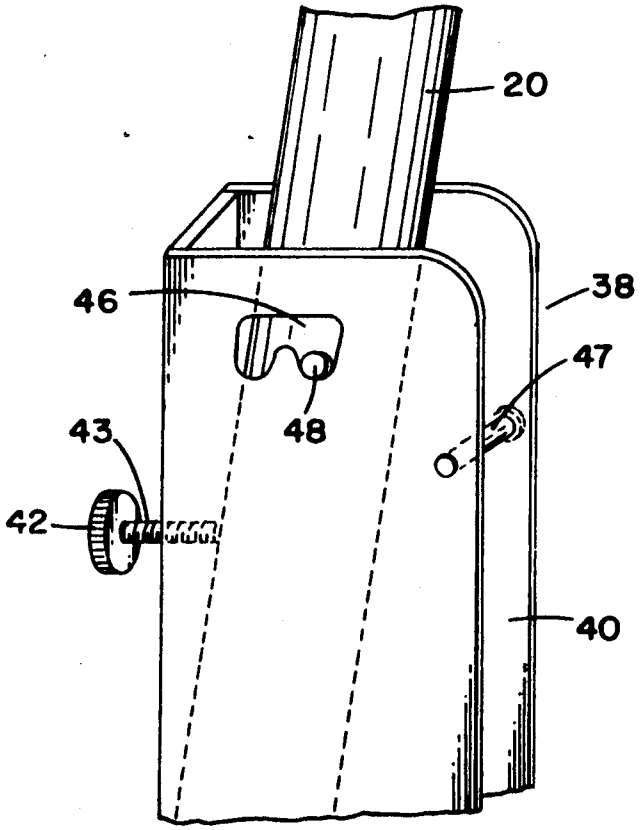
FIG. 5 is a perspective view of a shin support angle adjustment with an adjustment pin in a first position.

As shown in FIGS. 5 and 6, the shin support shaft 20 is held between opposite sides of the retainer bracket 40 having an adjustment slot with notches 46 formed therein. Adjustment pin 48 extends from the sides of the shin support shaft 20 and is placed in any of the sets of notches of slots 46 to provide various incremented separation distances from shaft 16, thereby setting any of various separation distances between pads 22 and 24. An adjustment knob 42 has a threaded shaft 43 fitting in a threaded opening in bracket 40. Shaft 43 has an end which pushes against shin support shaft 20 to provide continuous fine adjustment of the separation distance. By changing the angle of the shin support shaft 20, the position of the shin support pad 24 is changed and the distance between the shin support pad 24 and the seat cushion 22 may be varied. The adjustment knob 42 can be rotated to adjust the shin support angle adjustment 38 by hand or by the foot of a person standing on the base 12, so that leaving the stand 10 or stopping work to bend down and make angular adjustments is not required. The adjustment knob 42 is located at an elevation above the top of the frame 14, so that rotation of the knob 42 by the foot is not restricted by the frame 14.

The weight of the shin support pad 24 tends to rotate the shin support shaft 20 about pin 48. The shaft 43 of adjustment knob 42 engages the shin support shaft 20 below the pin 48 to retain the shin support shaft 20 in retainer bracket 40. The shin support shaft 20 is prevented from rotating in a reverse direction by pin 48 in slot 46 and by abutting a bolt 47 connecting the retainer plates 40 as shown in FIGS. 5 and 6. By supporting the shin support shaft 20 at pin 48 and at shaft 43, the angle of the shin support shaft is set by placing the adjustment pin 48 in one of the slots 46 and by rotating the adjustment knob 42 to push against the lower portion of shin support shaft 20 until the desired angle is obtained.

As shown in FIGS. 1 and 2, the shin support shaft 20 has a telescoping member 28 similar to the telescoping portions 26 and 27 of the seat support shaft 16. The shin support shaft 16 and telescoping member 28 are grooved in a manner similar to that shown in FIG. 3 to keep the shin support pad 24 aligned with a person supported on the stand 10. The telescoping member 28 is retained by a height adjustment lock 32 similar to the lock 30 shown in FIG. 4 for locking and releasing the telescoping portion 28 to adjust the elevation of the shin support pad 24.

Figure 8:
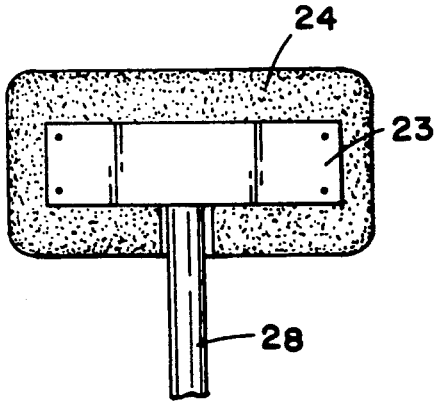
FIG. 8 is a view of the back of the shin support pad showing the back plate.
Figure 9:
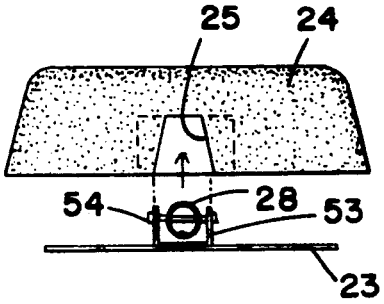
FIG. 9 is a bottom view of the shin support pad of FIG. 8 partially disassembled; and, FIG. 10 is a view of the back of the shin support pad of FIG. 8 with the back plate removed.
Figure 10:
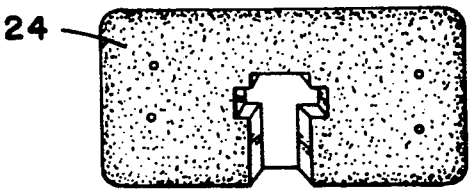

The shin support pad 24 attached to plate 23 is pivotally mounted on pin 54 at the upper end of the telescoping member 28 as shown in FIGS. 8–10. The telescoping member 28 extends into a shaft slot 25 formed between the shin support pad 24 and the shin pad back plate 23 as shown in FIG. 10. As shown in FIG. 9, the telescoping member 28 attaches at an upper end to pin 54. Bracket 53 is attached to the back plate 23 and pivots on pin 54. The shin support pad 24 and back plate 23 attached to the bracket 53 is free to pivot on the pin 54 within a limited range provided by the telescoping member 28 moving within the shaft slot 25. It can be appreciated that by having the telescoping member 28 inserted into the slot 25, less space is taken up by the shin support pad 24 and the person supported on the stand 10 is moved further forward, thereby decreasing the distance needed to reach forward to a work station and reducing the work performed. The shin support pad 24 pivots so that the shin pad back plate 23 remains parallel to the shin bones at the upper portion of the tibia, thereby reducing the compressive forces on the shins.

To use the stand 10, a person enters from either side. The lower telescoping member 26 is pulled upward to its highest position, in this manner the seat cushion 22 is adjusted to the desired elevation for supporting the posterior of the person by releasing the lock 31 and raising or lowering the upper telescoping member 27. The lock 31 is then moved to the locked position to set the seat cushion 22 at the desired elevation. The angle of the shin support shaft 20 is set by placing the adjustment pin 48 in one of the settings of slot 46. The fine adjustment knob 42 is then rotated so that the shaft 43 pushes the shin support shaft 20 to the desired angle at which the knees are slightly bent. The elevation of the shin support pad 24 is set in a manner similar to that for setting the elevation of the seat cushion 22. The lock 32 is released and the telescoping member 28 is raised or lowered until the shin support pad 24 is at an elevation to support the shins at a point just below the kneecaps.

It can be appreciated that when the body is supported by the stand 10, the pelvis is supported by the seat support cushion 22, as shown in FIG. 1. The seat cushion 22 is contoured to adapt to the posterior of a person as shown in FIG. 2. The lower center ridge 56 maintains the sacrum in a position slightly angled forward which places the pelvis in an upright position and prevents a person from sliding off the seat cushion 22. If supported in this manner, when lifting by the arms is required, the pelvis is not lifted with the rest of the upper body, decreasing the weight lifted and the distance moved, thereby minimizing the amount of work performed and reducing the strain on the body. The pelvis is supported in an upright position so that it is not tipped forward or retroflexed when supported by seat cushion 22. Supporting the knees so that they are slightly bent at an angle $\beta$ as shown in FIG. 1 wedges the body between the seat cushion 22 and shin pad 24 in one of the least stressful standing positions for standing. To minimize stress, angle $\beta$ is preferably about 165°–170°. Since the body is wedged between the shin support 24 and the seat cushion 22, the legs support less of the body weight so that swelling in the legs is decreased. In addition to reducing strain on the back by supporting the pelvis in an upright position, slightly bending the knees at the angle $\beta$ also tends to lengthen and relax the muscles of the lower back.

Figure 7:
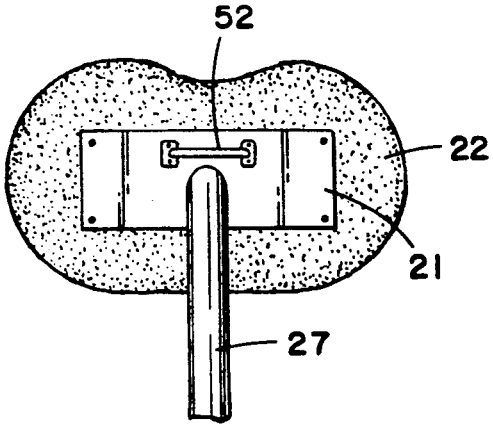
FIG. 7 is a view of the back of the seat cushion showing a handle.

As shown in FIGS. 1 and 2, the support stand has wheels 50 mounted on brackets (not shown) in the rear cross member of the frame 14 to provide for rolling the stand 10 when tipped back. A handle 52 is attached to the seat cushion back plate 21 as shown in FIG. 7. The wheels 50 extend the rear of frame 14 and do not engage the ground unless the stand is tilted back. When the stand 10 is tilted back, the wheels 50 engage the ground, so that the stand can be rolled on the wheels 50 instead of being carried, and can then be pulled or pushed by grasping the handle 52.

Finally, even though numerous characteristics and advantages of the present invention have been set forth in the foregoing description, together with details of the structure and function of the invention, it is understood that the disclosure is illustrative only, and changes made in detail, especially in matters of shape, size and arrangement of parts are within the principles of the invention to the full extent indicated by the broad general meaning of the terms in which the appended claims are expressed.

What is claimed is:

1. A support stand adapted for providing support at shins and posterior of a partially standing, working person, comprising:

(a) seat supporting means for supporting the posterior, said seat supporting means having a seat and first means for holding said seat at an angle not exceeding about 35 degrees from vertical;

(b) shin supporting means for supporting the shins, said shin supporting means including a shin support and second means for holding said shin support including means for limiting movement of said shin support to an angle wherein said person's knees are in a slightly bent position at an angle of about 165°–170° when the posterior is supported by said seat supporting means;

(c) a unitary, flat planar portion extending between said seat supporting means and of said shin supporting means and having width to allow said working person to stand thereon and thereby to stabilize said seat supporting means and said shin supporting means relative to one another, said seat supporting means and said shin supporting means having a space between one another, said seat supporting means including a lower first portion, said shin supporting means including a lower second portion;

means for attaching said first and second portions to said flat planar portion to provide rigidity and further stabilize said stand for said working person; and, (d) means for adjusting horizontal distance between said seat supporting means and said shin supporting means without spanning the space between said seat supporting means and said shin supporting means to accommodate lateral movements by said working person.

2. A support stand according to claim 1, wherein said seat supporting means comprises an adjustable telescoping support between said seat and said flat planar portion.

3. A support stand according to claim 1, wherein said shin supporting means comprises an adjustable telescoping support between said shin support and said flat planar portion.

4. A support stand according to claim 1, further comprising a handle attached to said seat supporting means and wheels operably attached to said flat planar portion for pushing and pulling the support stand.

5. A support stand according to claim 1, wherein said seat includes a raised portion generally contoured to the posterior.

6. A support stand according to claim 1 wherein said adjusting means includes means for incrementally varying horizontal distance and means for continuously varying horizontal distance, said incrementally varying means including a bracket having opposite sides rising from said flat planar portion each of said sides having a slot with a plurality of notches therein, and wherein said second holding means includes a support member having a pin extending from opposite sides thereof so as to fit in said notches, whereby movement of said support member so as to place said pin in notches closer or farther from said seat supporting means changes the horizontal distance between said shin supporting means and said seat supporting means.

7. A support stand according to claim 6 wherein said second holding means includes means for pivotally attaching said support member to said bracket and wherein said continuous varying means includes a foot-operable pin having an end in contact with said support member to pivot said support member and change horizontal distance between said shin support and said seat.

8. A support stand adapted for providing support at shins and posterior of a partially standing, working person, comprising:

seat supporting means for supporting the posterior, said seat supporting means having a lower first portion;

shin supporting means for supporting the shins, said shin supporting means having a lower second portion;

a flat planar portion on which said working person stands;

means for attaching said first and second portions to said flat planar portion, said seat supporting means and said shin supporting means having a space between one another; and means for adjusting horizontal distance between said seat supporting means and said shin supporting means without spanning the space between said seat supporting means and said shin supporting means to accommodate lateral movements by said working person, said adjusting means including first means for making discrete incremented variations in horizontal distance and second means for making continuous variations in horizontal distance between said seat and shin supporting means, said second variation making means including a foot-operable adjustment pin.

9. A support stand according to claim 8 including a member with an elevation greater than said planar portion and less than said adjustment pin, said member extending between said first and second supporting means.

* * * * *